US005450741A

United States Patent [19]

Baensch et al.

[11] Patent Number: 5,450,741

[45] Date of Patent: Sep. 19, 1995

[54] ROLL TOOL FOR COLD PILGER ROLLING OF PIPES

[75] Inventors: Michael Baensch, Mönchengladbach; Karl-Ernst Genter, Düsseldorf, both of Germany

[73] Assignee: Mannesmann Aktiengesellschaft, Dusseldorf, Germany

[21] Appl. No.: 134,919

[22] Filed: Oct. 12, 1993

[30] Foreign Application Priority Data

Oct. 9, 1992 [DE] Germany ..... 42 34 566.9

[51] Int. Cl.[6] ..... B21B 25/00

[52] U.S. Cl. ..... 72/208; 72/214; 72/252.5

[58] Field of Search ..... 72/208, 209, 214, 252.5, 72/370

[56] References Cited

U.S. PATENT DOCUMENTS 3,813,911 6/1974 Bibighaus ..... 72/208

FOREIGN PATENT DOCUMENTS 529858 9/1976 U.S.S.R. ..... 72/214
602245 4/1978 U.S.S.R. ..... 72/208
880524 11/1981 U.S.S.R. ..... 72/208
1437119 11/1988 U.S.S.R. ..... 72/208

*Primary Examiner*—Lowell A. Larson
*Assistant Examiner*—Thomas C. Schoeffler
*Attorney, Agent, or Firm*—Cohen, Pontani, Lieberman, Pavane

[57] ABSTRACT

A roll tool for cold pilger rolling of pipes in which the reducing zones of the two tool grooves, starting from the transition from the reducing zone to the smoothing zone, have transitional areas without kinks which extend parabolically. The curve describing the mandrel groove runs parallel to the parabolic transitional area of the roll groove proceeding from the location of the narrowest gap between the roll and mandrel while forming a wall smoothing zone.

1 Claim, 1 Drawing Sheet

ROLL TOOL FOR COLD PILGER ROLLING OF PIPES

BACKGROUND OF THE INVENTION

1. Field of the Invention

The invention is directed to a roll tool for cold pilger rolling of pipes. The tool having a pair of rolls which can be moved in a reciprocating manner and roll along the intermittently stationary pipe and a roll mandrel which is held in the interior of the pipe. The rolls and roll mandrel are grooved so that the gap between the roll and the mandrel decreases continuously in a first reducing groove zone from the rough-pierced wall thickness to the finished wall thickness of the rolled pipe until reaching a minimum conicity of the two tools. The dimensional accuracy of the finished pipe is brought about in an adjoining smoothing groove zone with a slightly conical mandrel geometry.

2. Description of the Prior Art

Such roll tools are used to produce pipes from rough-pierced tube blanks with dimensional accuracy. In the smoothing groove, the dimensional accuracy of the finished pipe is brought about in that—ideally—the mandrel and roll groove are cylinders with a constant diameter in this region. Unfortunately, this ideal geometry can only be realized in the mandrel when copper is used as a working material for the pipe. Other materials require a slightly conical mandrel geometry in the smoothing groove.

In formerly conventional grooves with constant wall reduction in the entire reducing groove region, the different requirements for the amount of taper in the reducing groove and the smoothing groove result in kinks in both tools. As can readily be understood, such kinks are undesirable and should be avoided as far as possible. When smoothing out these kinks, i.e. grinding or polishing a transition, there is a risk that a necked-down portion will be produced in the mandrel by grinding and that the pipe will be rolled into this necked-down portion during the pilger rolling process. As a result, high longitudinal forces occur on the mandrel as the rolling process progresses, which can lead to destruction of the mandrel.

SUMMARY OF THE INVENTION

Accordingly, it is an object of the present invention to prevent the kink in the transition from the reducing groove to the smoothing groove without causing disadvantages in the rolling process.

Pursuant to this object, and others which will become apparent hereafter, one aspect of the present invention resides in providing the reducing zones of the two tool grooves, starting from the transition from the reducing zone to the smoothing zone, with transitional areas that extend parabolically, where the curve describing the mandrel groove runs in the direction of the smoothing zone parallel to the parabolic transitional area of the roll proceeding from the location of the narrowest gap between the roll and mandrel.

The invention thus provides first that the straight lines of the minimum amount of taper pertaining to the grooving of the two tools be replaced, starting from the boundary point between the reducing groove and smoothing groove, by parabolic transitional areas. However, this is not sufficient in itself, since the transitions from the reducing groove to the smoothing groove which are accordingly made free of kinks have the disadvantage that the narrowest gap between the tools already occurs shortly before the end of the reducing groove. This results in a necking down of the pipe wall at this location which leads to an upsetting of the pipe wall as the outer diameter is further reduced. This is prevented by the present invention in that, in the suggested construction of the transitional zone of the roll, this configuration at the mandrel is maintained only as far as the narrowest point between the roll and the mandrel groove. Proceeding from this point, the mandrel curve runs parallel to the curve describing the roll groove. This results in a portion with a constant gap between the tools in which the pipe wall is provided with the desired finished dimensions in a very accurate manner.

The various features of novelty which characterize the invention are pointed out with particularity in the claims annexed to and forming a part of the disclosure. For a better understanding of the invention, its operating advantages, and specific object attained by its use, reference should be had to the drawing and descriptive matter in which there are illustrated and described preferred embodiments of the invention.

DETAILED DESCRIPTION OF THE PREFERRED EMBODIMENTS

Figure 1:
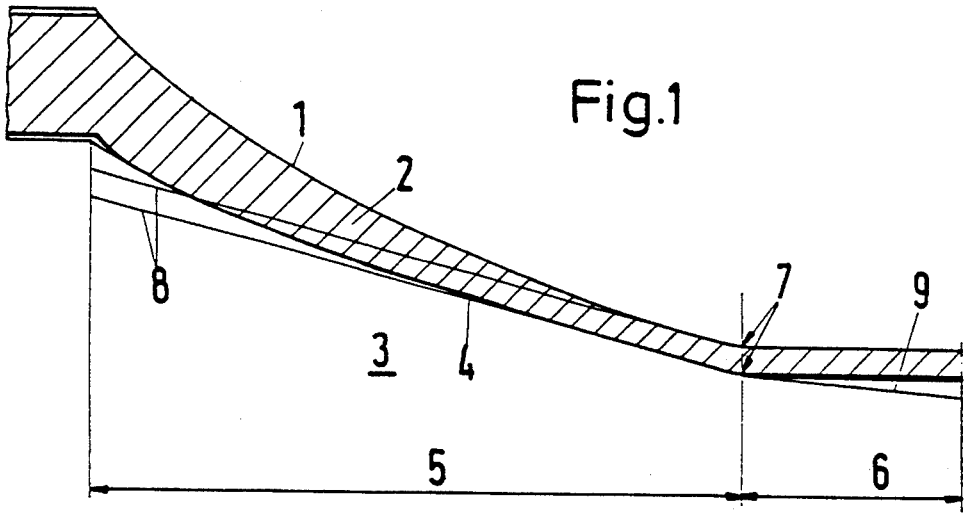
FIG. 1 shows a conventional grooving of a cold pilger rolling tool.

In FIG. 1, the unwinding of the groove of the roll of a cold pilger rolling tool is designated by 1. The wall of the pipe between the roll 1 and the mandrel 3 is designated by 2. The unwinding of the groove of the mandrel 3 is designated by 4. The mandrel 3 and roll 1 are divided into a reducing zone 5 and a smoothing zone 6. As can be seen in the drawing, the reducing zone 5 narrows continuously and accordingly reduces the wall of the pipe 2 from the rough-pierced wall thickness to the finished pipe wall thickness. There is no longer any noteworthy reduction in the wall in the smoothing groove 6. Only the finished pipe diameter is improved.

FIG. 1 shows at 7 that a kink is formed between the reducing zone and the smoothing zone in that the minimum amount of taper 8 of the smoothing zone required in this region is different from the amount of taper 9 of the mandrel 3 in the smoothing zone.

Figure 2:
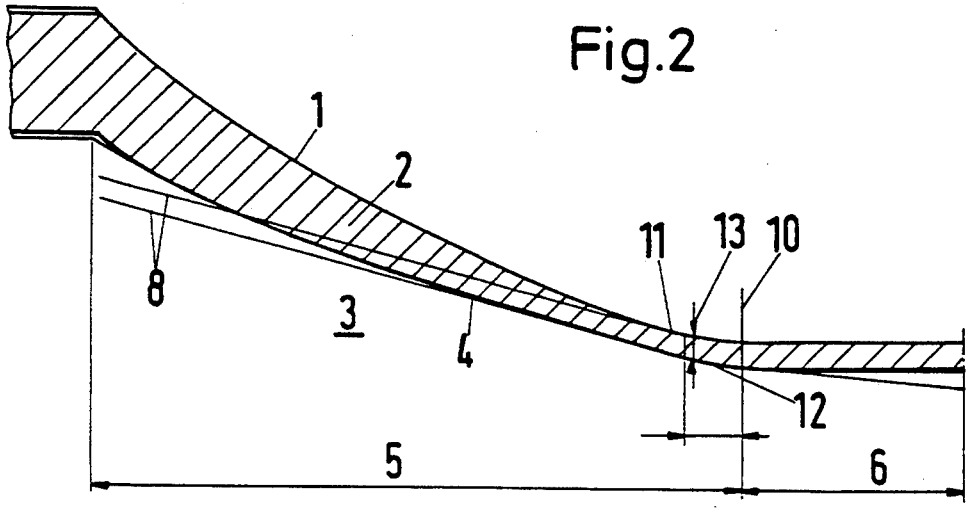
FIG. 2 shows the grooving with a kink-free transition.

In FIG. 2, this kink is avoided in that the straight lines 8 of the minimum amount of taper at the two tools, which straight lines 8 represent a component of the grooving, have been replaced by parabolas 11, 12 from the boundary point 10 between the reducing zone 5 and the smoothing zone 6. However, it can be seen at 13 that the narrowest gap lies in the region of the reducing zone 5 and leads to a constriction of the pipe wall at this location.

Figure 3:
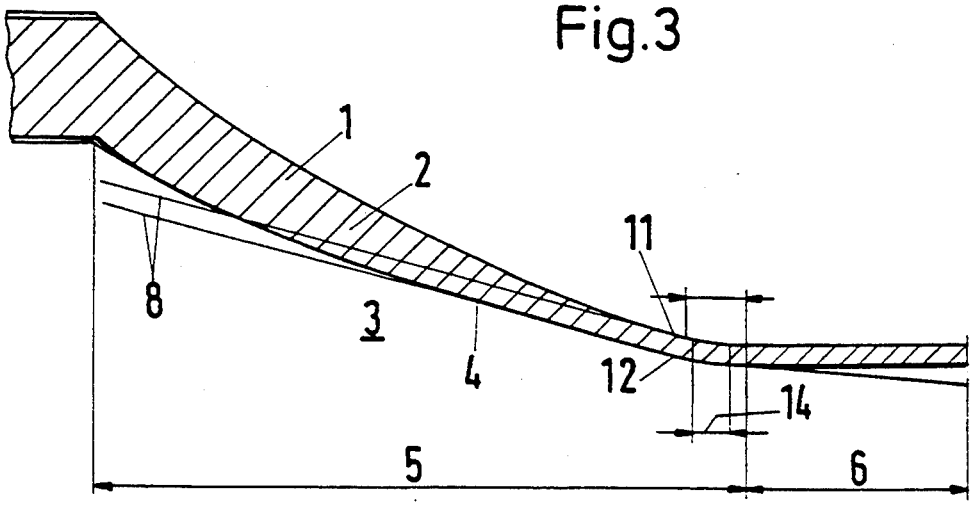
FIG. 3 shows the grooving according to the invention with wall smoothing zone and a kink-free transition.

As is shown in FIG. 3, this narrowest gap is prevented by a wall smoothing zone 14 in the region of the mandrel 3 in which, proceeding from the narrowest gap 13, the curve describing the mandrel geometry runs parallel to the parabolic transitional area 11 of the roll. It can be seen clearly from the view in FIG. 3 that there accordingly remains a constant gap between the roll tools which enables the sizing of the pipe.

The invention is not limited by the embodiments described above which are presented as examples only but can be modified in various ways within the scope of protection defined by the appended patent claims.

We claim:

1. A roll tool for cold pilger rolling of a pipe comprising: a pair of grooved rolls which are movable in a reciprocating manner and are rollable along the pipe as it is held intermittently stationary; and, a grooved roll mandrel arranged at a gap from the grooved rolls and so as to be holdable in an interior of the pipe, both the rolls and the roll mandrel being grooved so that the gap between each roll and the mandrel decreases continuously in a reducing groove zone from a rough-pierced wall thickness to a finished wall thickness of the rolled pipe until reaching a narrowest point at a minimum amount of taper of the rolls and the roll mandrel, a smoothing groove zone adjoining the reducing groove zone and having a slightly conical mandrel geometry to provide dimensional accuracy of the finished pipe, the reducing zones of the grooves of the rolls and the roll mandrel, starting from a transition from the reducing zone to the smoothing zone, have kink-free transitional areas which extend parabolically, the mandrel groove describing a curve that runs parallel to the parabolic transitional area of each roll groove proceeding from the location of the narrowest gap between the rolls and mandrel while forming a wall smoothing zone with a uniform gap.

* * * * *